US007926580B1

(12) United States Patent
Darnell et al.

(10) Patent No.: US 7,926,580 B1
(45) Date of Patent: Apr. 19, 2011

(54) COILED TUBING MULTI-ZONE JET FRAC SYSTEM

(75) Inventors: William Ryle Darnell, St. Martinville, LA (US); William John Darnell, Houston, TX (US); Todd Ulrich Chretien, Sr., Layfette, LA (US)

(73) Assignee: Petroquip Energy Services, LLP, Houston, TX (US)

( * ) Notice: Subject to any disclaimer, the term of this patent is extended or adjusted under 35 U.S.C. 154(b) by 0 days.

(21) Appl. No.: 12/887,940

(22) Filed: Sep. 22, 2010

Related U.S. Application Data

(60) Provisional application No. 61/245,100, filed on Sep. 23, 2009.

(51) Int. Cl.
*E21B 33/12* (2006.01)
*E21B 34/06* (2006.01)

(52) U.S. Cl. ..... 166/386; 166/373

(58) Field of Classification Search ..... 166/313, 166/386, 373, 332.4
See application file for complete search history.

(56) References Cited

U.S. PATENT DOCUMENTS

| | | | | |
|---|---|---|---|---|
| 5,355,953 | A * | 10/1994 | Shy et al. | 166/250.1 |
| 5,479,989 | A * | 1/1996 | Shy et al. | 166/332.4 |
| 5,533,571 | A | 7/1996 | Surjaatmadja et al. | |
| 6,053,250 | A | 4/2000 | Echols | |
| 6,053,254 | A * | 4/2000 | Gano | 166/384 |
| 6,394,184 | B2 * | 5/2002 | Tolman et al. | 166/281 |
| 6,520,255 | B2 * | 2/2003 | Tolman et al. | 166/281 |
| 6,725,934 | B2 * | 4/2004 | Coronado et al. | 166/313 |
| 6,889,771 | B1 * | 5/2005 | Leising et al. | 166/373 |
| 6,957,701 | B2 * | 10/2005 | Tolman et al. | 166/281 |
| 7,051,812 | B2 * | 5/2006 | McKee et al. | 166/305.1 |
| 7,066,264 | B2 * | 6/2006 | Bissonnette et al. | 166/305.1 |
| 7,108,067 | B2 * | 9/2006 | Themig et al. | 166/317 |
| 7,416,029 | B2 | 8/2008 | Telfer et al. | |
| 7,543,634 | B2 * | 6/2009 | Fehr et al. | 166/191 |
| 7,637,317 | B1 * | 12/2009 | Hernandez et al. | 166/177.5 |
| 7,712,538 | B2 * | 5/2010 | Fay | 166/332.4 |
| 7,748,460 | B2 * | 7/2010 | Themig et al. | 166/317 |
| 2003/0221838 | A1 * | 12/2003 | Dallas | 166/373 |
| 2008/0179060 | A1 | 7/2008 | Surjaatmadja et al. | |
| 2009/0000786 | A1 | 1/2009 | Daniels et al. | |
| 2010/0044041 | A1 * | 2/2010 | Smith et al. | 166/280.1 |
| 2010/0132959 | A1 * | 6/2010 | Tinker | 166/386 |
| 2010/0243253 | A1 * | 9/2010 | Surjaatmadja et al. | 166/298 |
| 2010/0243266 | A1 * | 9/2010 | Soby et al. | 166/373 |
| 2010/0252280 | A1 * | 10/2010 | Swor et al. | 166/386 |
| 2010/0299619 | A1 * | 11/2010 | Rowlett et al. | 715/760 |

* cited by examiner

*Primary Examiner* — David J Bagnell
*Assistant Examiner* — Sonya Bible
(74) *Attorney, Agent, or Firm* — Buskop Law Group, PC; Wendy Buskop

(57) ABSTRACT

A coiled tubing multi-zone frac system for fracing a formation adjacent a well using a sliding sleeve and erodible jets. Erodible jets can provide a means for perforating, fracing and flowing the well which takes the place of two separate tools that are otherwise needed to cause a well to flow, namely, this single tool replaces a perforating gun, a production sleeve.

8 Claims, 6 Drawing Sheets

COILED TUBING MULTI-ZONE JET FRAC SYSTEM

CROSS REFERENCE TO RELATED APPLICATIONS

The present application claims priority to and the benefit of U.S. Provisional Patent Application Ser. No. 61/245,100 filed on Sep. 23, 2009, entitled "COILED TUBING MULTI-ZONE JET FRAC SYSTEM". This application is incorporated herein in its entirety.

FIELD

The present embodiments generally relate to a coiled tubing multi-zone frac system with a sliding sleeve for fracing a formation adjacent a well bore.

BACKGROUND

A need exists for a coiled tubing method which enables multi-zone fracing of a well with a movable sleeve.

The present embodiments meet these needs.

BRIEF DESCRIPTION OF THE DRAWINGS

The detailed description will be better understood in conjunction with the accompanying drawings as follows.

Figure 1:
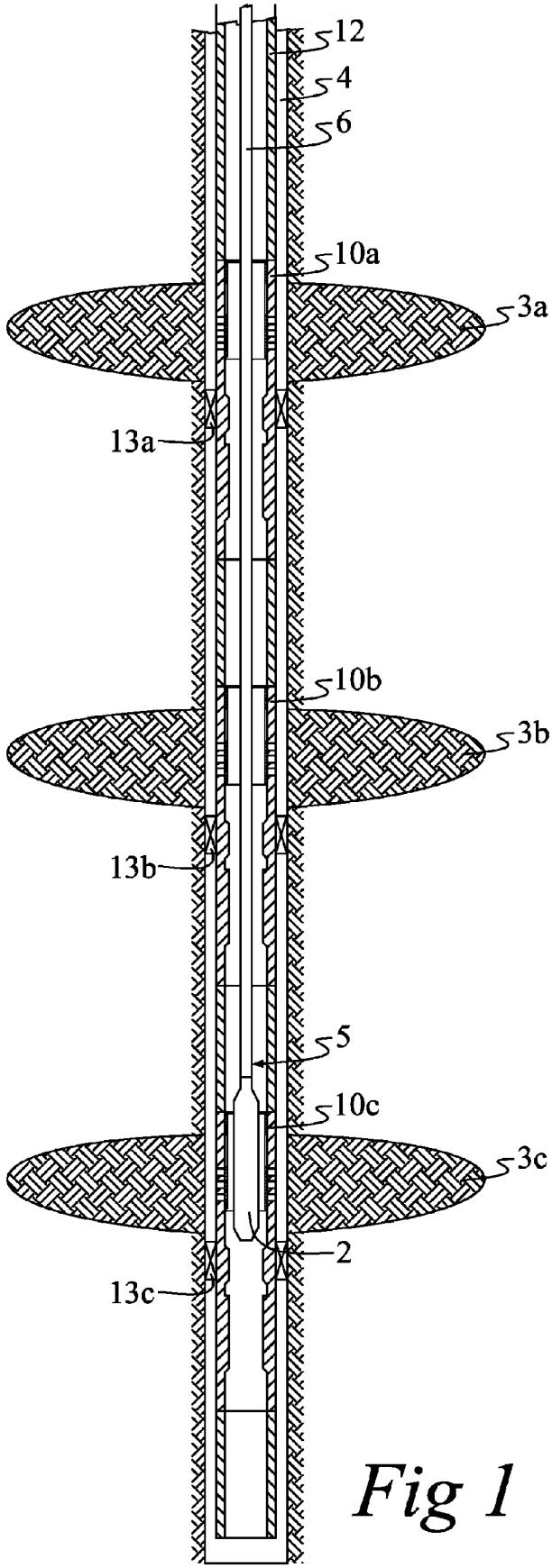
FIG. 1 depicts a cross sectional view of a coiled tubing multi-zone jet frac tool in a well bore.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The embodiments relate to a coiled tubing multi-zone frac system for fracing a formation adjacent a well bore.

The system can include a coiled tubing multi-zone jet frac tool, which can be disposed in a tubing, wherein the coiled tubing multi-zone jet frac tool can be secured to a first end of a movable coiled tubing work string.

The system can include one or more sliding sleeve disposed in the tubing in the well bore adjacent the formation. For example, a sliding sleeve can connect a first portion of the tubing to a second portion of the tubing.

The sliding sleeve can include a body. The body can have a first end and a second end.

A plurality of perforations can be disposed between the first end and the second end. The plurality of perforations can provide fluid communication between the tubing and the well bore.

A slidable internal sleeve can be disposed within the body, which can further have a plurality of ports, which can further be adapted to align with the plurality of perforations and provide a fluid flow between the tubing and the well bore.

A locking profile can be disposed in the tubing proximate to the second end of the body and can have a seal bore disposed in the tubing between the plurality of ports and the locking profile, which can further provide a sealing engagement with the coiled tubing multi-zone jet frac tool.

A coiled tubing multi-zone jet frac tool can be used with the sliding sleeve. The coiled tubing multi-zone jet frac tool can have an internal tubular core with an internal tubular core first end with a shoulder, an internal tubular core second end, a first port, which can be located between the shoulder and the internal tubular core second end, a second port, which can be located between the first port and the internal tubular core second end.

The coiled tubing multi-zone jet frac tool can also have a slidable pack off mandrel that can include a first mandrel end with a first pack off element. A second mandrel end can have a drag collet for slidably engaging the internal tubular core and a locking key retainer.

When the coiled tubing multi-zone jet frac tool is run into the hole, the locking key retainer can compress at least one locking key. Once the coiled tubing multi-zone jet frac tool is in the hole, at least one locking key can expand and engage a lock profile in the sliding sleeve.

The locking key retainer can be made up of a locking key retainer sleeve and a locking key retainer dog for engaging a seal bore of the at least one sliding sleeve. The locking key retainer dog can also engage the seal bore, shear the shearable fastener, pull the sleeve, and expose at least one locking key.

The locking keys can be disposed between the first mandrel end and the second mandrel end. At least one locking key can be secured to the slidable pack off mandrel.

A shearable fastener can be disposed on the second mandrel end to engage the internal tubular core. The shearable fastener can shear when a locking key engages the locking profile causing the coiled tubing multi-zone jet frac tool to move into a pack off position. The shearable fasteners can be a shear pin.

A shifting tool can be disposed adjacent the internal tubular core second end for moving the sliding sleeve from a closed position to an open position after the coiled tubing multi-zone jet frac tool is moved through the sliding sleeve.

The shifting tool can have a collet disposed around the internal tubular core for engaging the slidable internal sleeve when the internal tubular core is moved by the movable coiled tubing work string.

One or more perforation from the plurality of perforations can have one or more jets disposed therein. One or more of the ports from the plurality of ports can have one or more jests disposed therein. The jets can be erodible.

Turning now to the Figures, FIG. 1 depicts a cross sectional view of the coiled tubing multi-zone jet frac tool 2 in a well bore 4.

The coiled tubing multi-zone jet frac tool 2 can be in a tubing 12 of the well bore 4. The tubing 12 can have multiple sliding sleeves 10*a*, 10*b*, and 10*c* and each sliding sleeve can be adjacent a different formation 3*a*, 3*b*, and 3*c*

The coiled tubing multi-zone jet frac tool 2 can be secured to a first end 5 of a movable coiled tubing work string 6.

Each sliding sleeve 10*a*, 10*b*, and 10*c* can be disposed in the tubing 12 in the well bore 4 adjacent the formations 3*a*, 3*b*, and 3*c*. Each section of the formation can be separated by a packer 13*a*, 13*b*, and 13*c*. The packer can be inflatable packers, swellable packers, cup packers, other packers known to one skilled in the art, or combinations thereof.

Figure 2A:
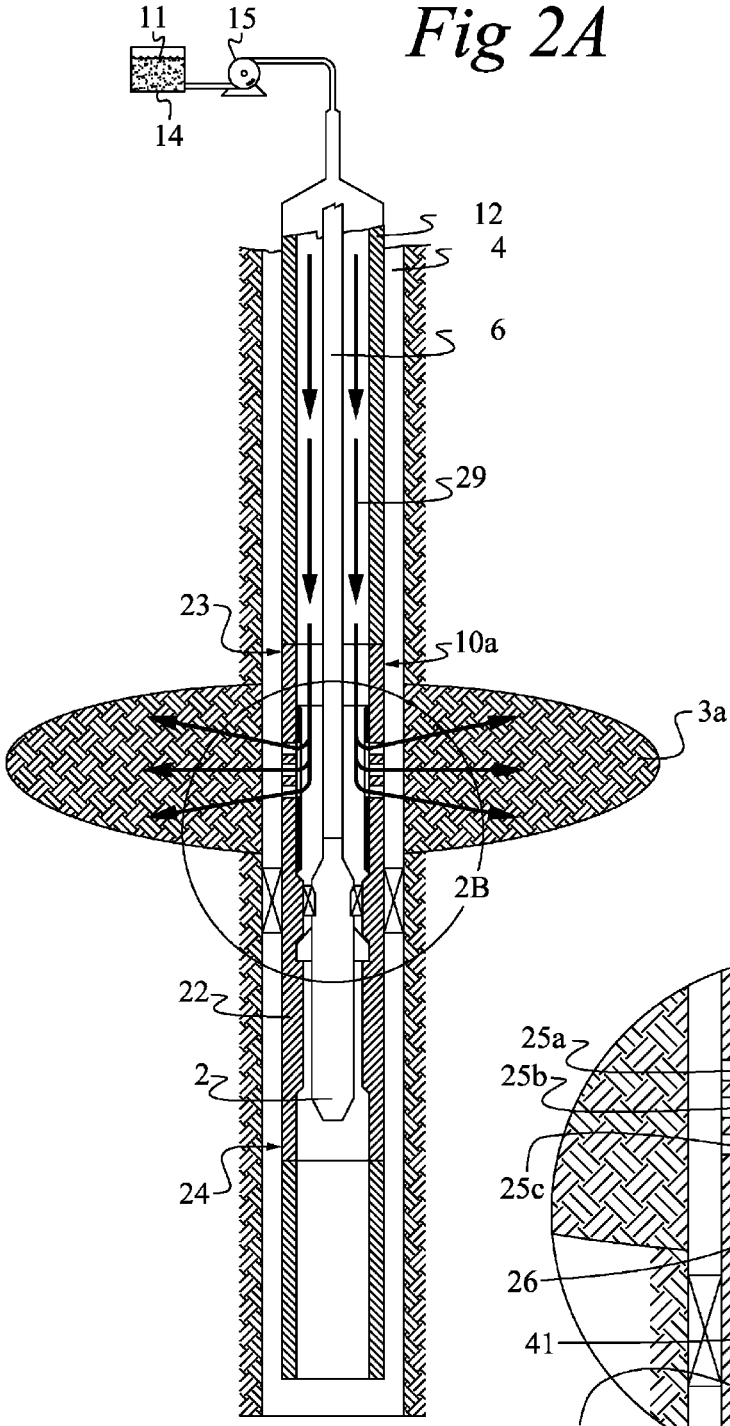
FIGS. 2A and 2B depict a view of a zone in the well bore with the coiled tubing multi-zone jet frac tool in the frac position.
Figure 2B:
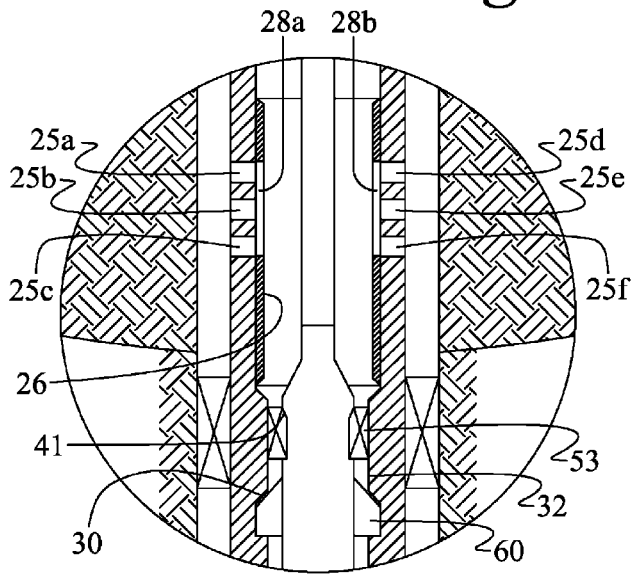

FIGS. 2A and 2B depict a well bore 4 and a view of a zone in the well bore 4 with the coiled tubing multi-zone jet frac tool 2 in the frac position.

Fracing can be initiated when the fluid 11 is pumped through the plurality of ports 28*a* and 28*b* and the plurality of perforations 25*a*, 25*b*, 25*c*, 25*d*, 25*e*, and 25*f* into at least one formation, such as formation 3*a*.

The sliding sleeve 10*a* can be disposed adjacent the formation. The sliding sleeve 10 can include a sliding sleeve body 22, a first end 23, and a second end 24.

FIG. 2B shows a plurality of perforations 25*a*, 25*b*, 25*c*, 25*d*, 25*e*, and 25*f*, which can be disposed between the first end 23 and the second end 24.

The plurality of perforations 25*a*, 25*b*, 25*c*, 25*d*, 25*e*, and 25*f* can provide fluid communication between the tubing 12 and the well bore 4.

A slidable internal sleeve 26 can be disposed within the sliding sleeve body 22. The slidable internal sleeve 26 can have a plurality of ports 28*a* and 28*b*. The plurality of ports are shown in this Figure as aligned with the plurality of perforations 25*a* and 25*b*, 25*c*, 25*d*, 25*e*, and 25*f*. The plurality of ports and the plurality of perforations can provide a fluid flow 29 between the tubing 12 and the well bore 4.

Returning to FIGS. 2A and 2B, the fluid 11 can be a fluid/particulate mixture. The fluid/particulate mixture can be held in a reservoir 14 and pumped with a pump 15 from a position outside the well bore 4 to an inside diameter of the tubing 12 to the coiled tubing work string 6.

A locking profile 30 can be formed in the tubing 12 proximate to the second end 24 of the sliding sleeve body 22. The locking profile 30 can engage a locking key 60 to prevent moving of the coiled tubing multi-zone jet frac tool 2 further into the well bore 4.

A seal bore 32 can be disposed in the tubing 12 adjacent locking key 60. The seal bore 32 can be engaged by a first pack off element 53. The first pack off element 53 can also engage a first shoulder 41 forming a sealing engagement at the seal bore 32.

Figure 3A:
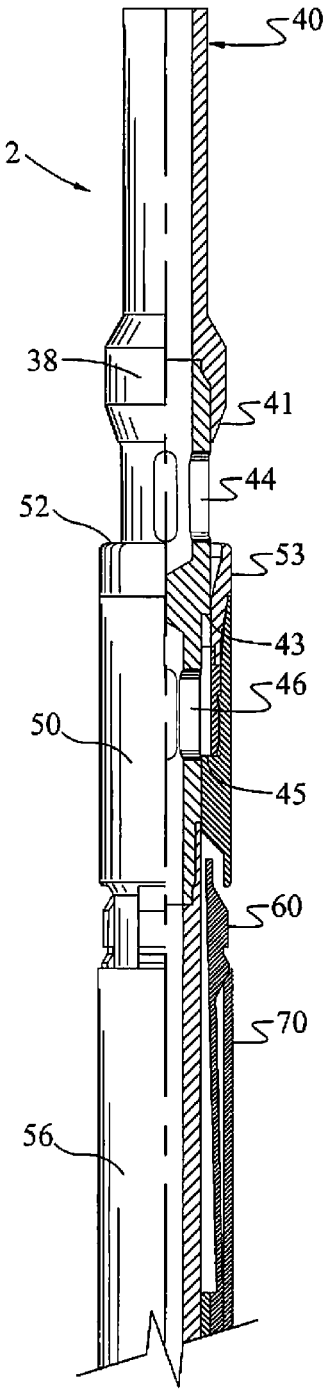
FIGS. 3A and 3B depict a cross sectional view of coiled tubing multi-zone jet frac tool in the run in position.
Figure 3B:
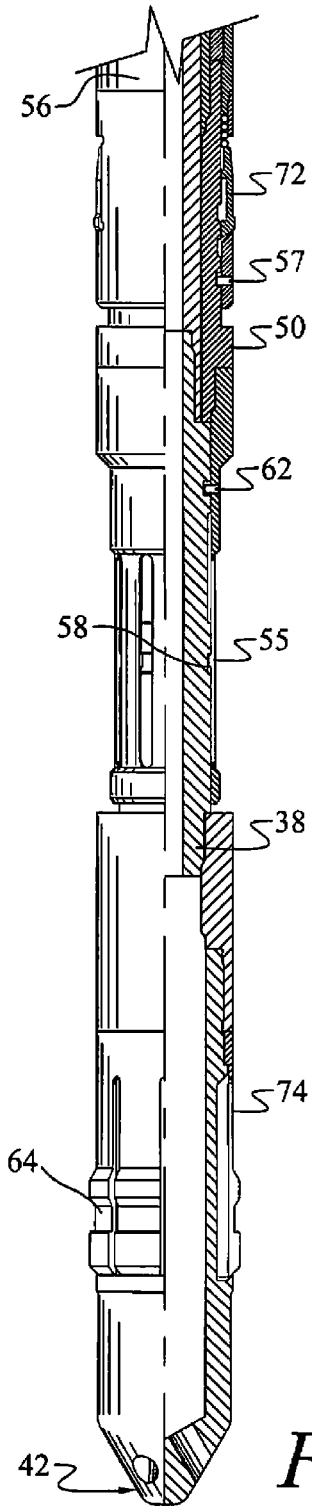

FIG. 3A depicts a cross sectional view of a first half of a coiled tubing multi-zone jet frac tool 2 in the "run in" position. FIG. 3B depicts a cross sectional view of the bottom half of the coiled tubing multi-zone jet frac tool 2.

Referring to FIGS. 3A and 3B, the coiled tubing multi-zone jet frac tool 2 can have an internal tubular core 38 with an internal tubular core first end 40. A first shoulder 41 can be disposed between the internal tubular core first end 40 and a first port 44. The second shoulder 43 and the third shoulder 45 can also be seen, but are discussed in detail in FIG. 5A. The second port 46 can be adjacent the second shoulder 43 shown in FIG. 3B.

A first pack off element 53 can be located on a first mandrel end 52 of a slidable pack off mandrel 50.

The locking key 60 is shown in a collapsed position. A locking key retainer sleeve 70 is shown collapsing the locking key 60 and forming a portion of the locking key retainer 56.

The internal tubular core second end 42 can have a locking key retainer dog 72, which can engage the locking key retainer 56. A locking key retainer fastener 57 holds the locking key retainer sleeve 70 to the slidable packoff mandrel 50.

A shearable fastener 62, which can be a shear pin, a shear ring or shear screw, can hold the slidable pack off mandrel 50 to the internal tubular core 38.

A drag collet 55 can be part of the slidable pack off mandrel 50. The drag collet 55 can have a plurality of slots and protrusions for engaging a first groove 58 of the internal tubular core 38.

The internal tubular core second end 42 can have a shifting tool 64, which can have a collet 74.

Figure 4A:
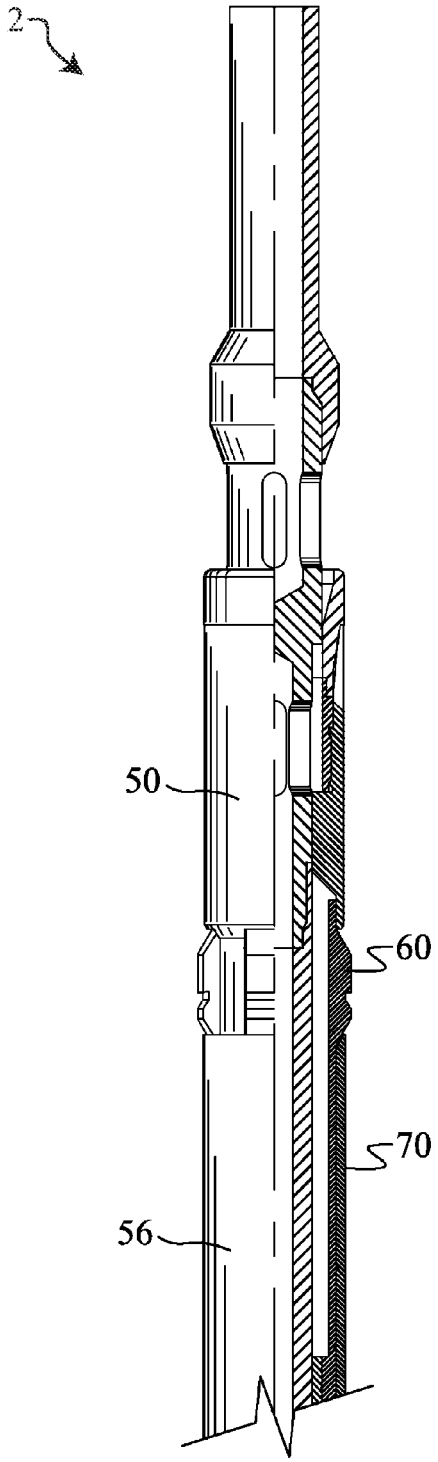
FIGS. 4A and 4B depict a cross sectional view of the coiled tubing multi-zone jet frac tool in the seeking position.
Figure 4B:
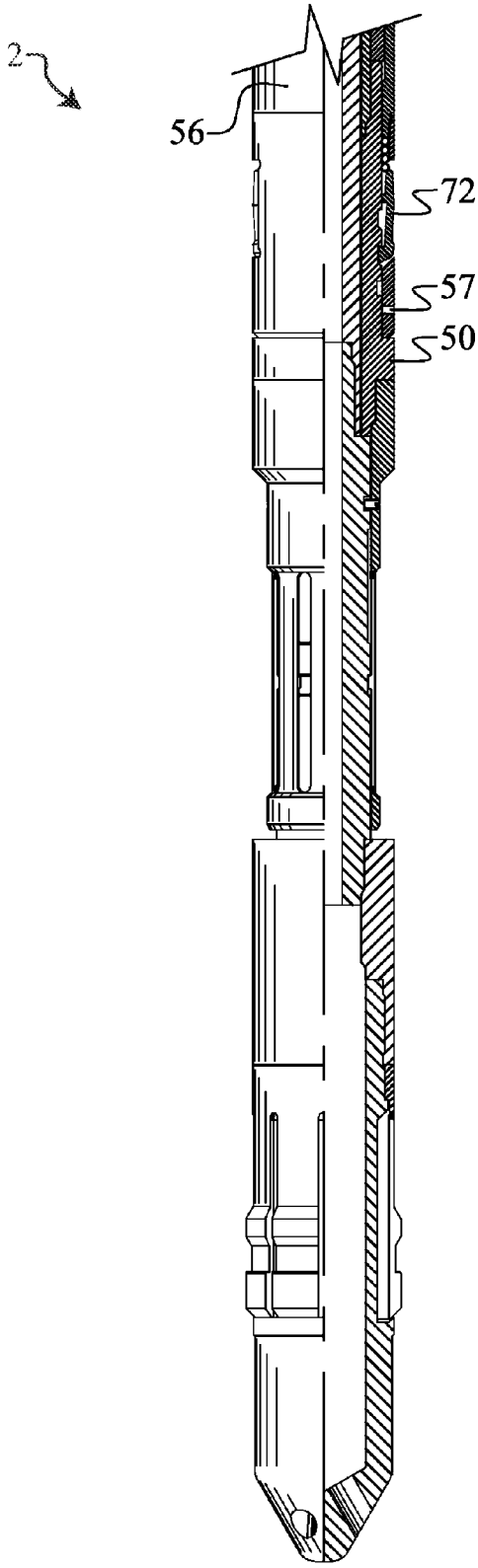

FIGS. 4A and 4B depicts cross sectional views of the coiled tubing multi-zone jet frac tool 2 in the seeking position.

Referring to FIGS. 4A and 4B, the coiled tubing multi-zone jet frac tool 2 can be in a "seeking position" and the locking key 60 can be in an expanded orientation. When the coiled tubing multi-zone jet frac tool 2 is in the "seeking position," the locking key retainer sleeve 70 can be disengaged from the locking key 60.

In addition, when the coiled tubing multi-zone jet frac tool 2 is in the seeking position, the locking key retainer dog 72 can be in a "collapsed" position. The collapsed position can further be referred to as a "locked out" non-engagable position. The locking key retainer fastener 57 can be been sheared off by the sliding engagement of the locking key retainer 56 along the slidable packoff mandrel 50.

Figure 5A:
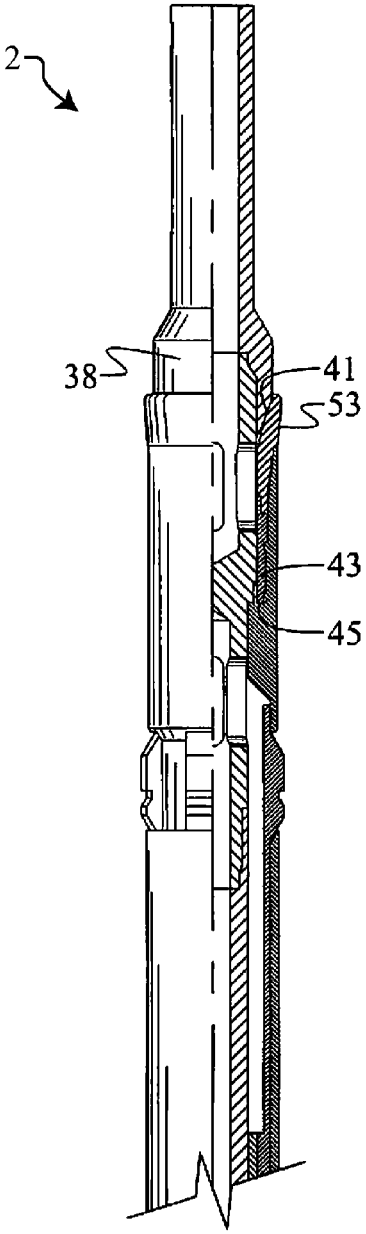
FIGS. 5A and 5B depict a cross sectional view of the coiled tubing multi-zone jet frac tool in the pack off position.
Figure 5B:
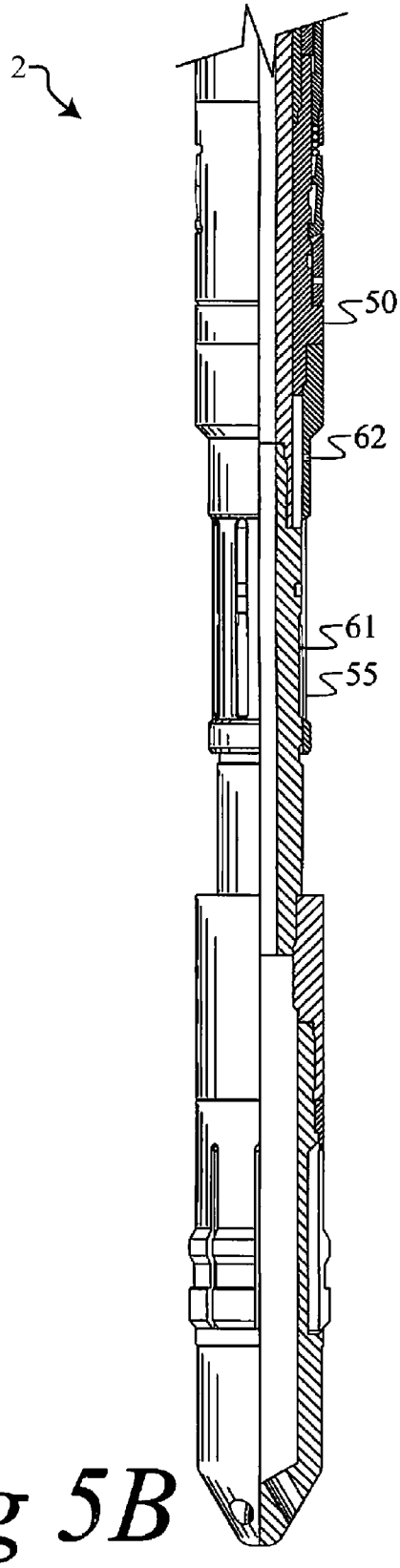

FIGS. 5A and 5B depict cross sectional views of the coiled tubing multi-zone jet frac tool 2 in the pack off position.

Referring to FIGS. 5A and 5B, a first portion of the coiled tubing multi-zone jet frac tool 2 in the pack off position. The first shoulder 41 is shown engaging the first pack off element 53. Additionally the first pack off element 53 is shown in the expanded position. The slidable pack off mandrel 50 can have limited movement due to the contact of a second shoulder 43 and a third shoulder 45.

The shearable fastener 62 has been sheared allowing the slidable pack off mandrel 50 to move over the internal tubular core 38 to drive the first shoulder 41 into the first pack off element 53. The drag collet 55 can be positioned on the internal tubular core 38 and can connect with the second groove 61.

Figure 6:
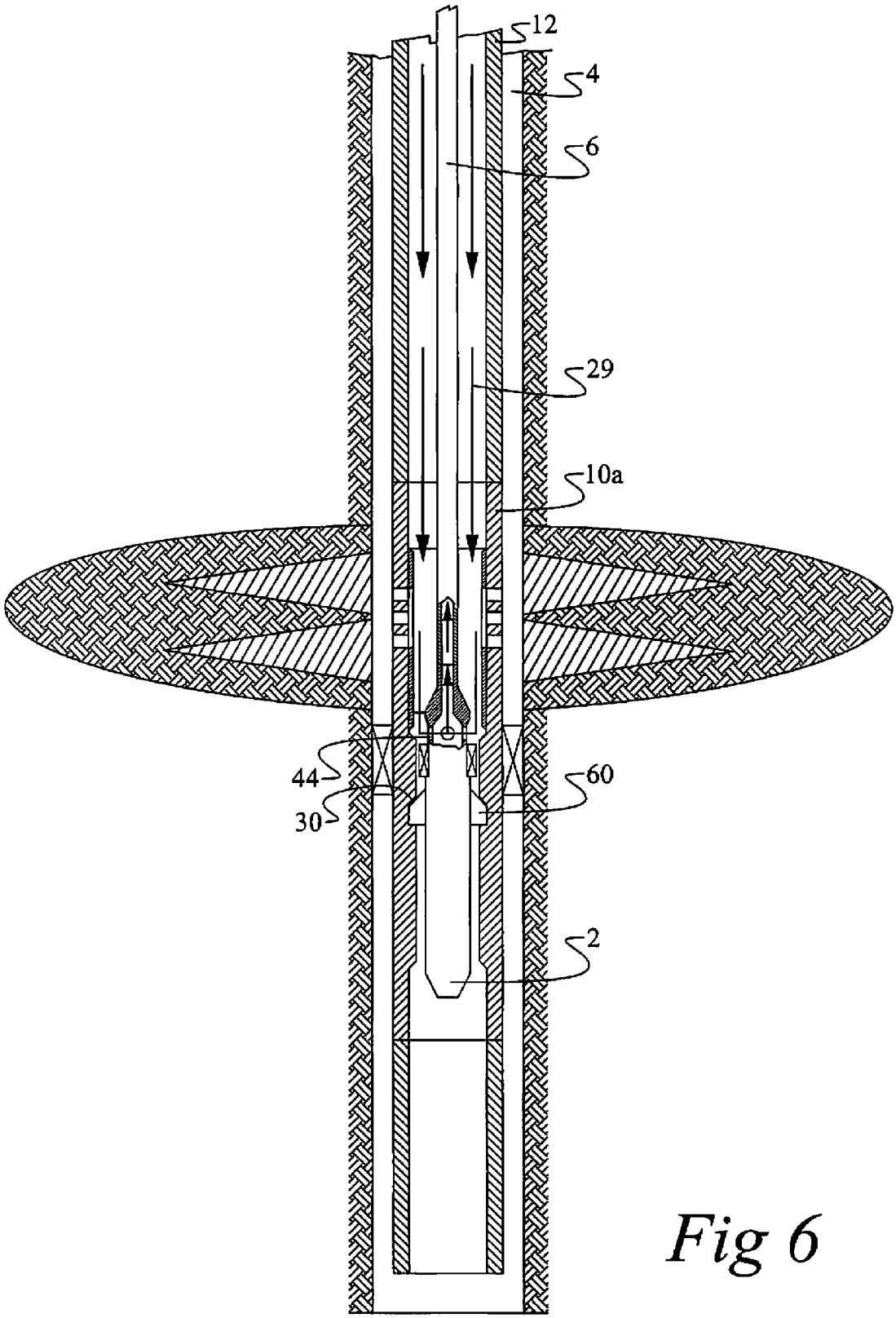
FIG. 6 depict a detail of the well bore with the coiled tubing multi-zone jet frac tool in a reverse position.

FIG. 6 depicts a detail of the well bore 4 with the coiled tubing multi-zone jet frac tool 2 in a reverse frac position.

The well bore 4 is depicted having the coiled tubing multi-zone jet frac tool 2 and the sliding sleeve 10*a*.

The coiled tubing multi-zone jet frac tool 2 can use the locking key 60 to engage the locking profile 30. The coiled tubing multi-zone jet frac tool 2 is shown in the seeking position as shown in FIGS. 4A and 4B.

Fluid flow 29 can travel between the tubing 12 and the movable coiled tubing work string 6 to the first port 44 and up the inner diameter of the movable coiled tubing work string 6, flushing out any fluid remaining in the well bore 4 to the surface.

While these embodiments have been described with emphasis on the embodiments, it should be understood that within the scope of the appended claims, the embodiments might be practiced other than as specifically described herein.

What is claimed is:

1. A coiled tubing multi-zone frac system for fracing a formation adjacent a well bore, wherein the system comprises:

a. a coiled tubing multi-zone jet frac tool disposed in a tubing, wherein the coiled tubing multi-zone jet frac tool is secured to a first end of a coiled tubing, wherein the coiled tubing multi-zone jet frac tool comprises:

(i) an internal tubular core with an internal tubular core first end with a shoulder, an internal tubular core second end, a first port located between the shoulder and the internal tubular core second end, a second port located between the first port and the internal tubular core second end;

(ii) a slidable pack off mandrel comprising:

1. a first mandrel end with a first pack off element;
2. a second mandrel end with a drag collet for slidably engaging the internal tubular core and a locking key retainer;
3. at least one locking key for engaging with the locking key retainer disposed between the first mandrel end and the second mandrel end, wherein the at least one locking key is secured to the slidable pack off mandrel with a locking key retainer fastener; and
4. at least one shearable fastener disposed on the second mandrel end, wherein the slidable pack off mandrel slidably engages the internal tubular core; and (iii) a shifting tool disposed adjacent the internal tubular core second end;

b. a sliding sleeve connected to the tubing, wherein the sliding sleeve comprises:

(i) a body comprising:

1. a first end; and
2. a second end;

(ii) a plurality of perforations disposed between the first end and the second end of the body, wherein the plurality of perforations provide a fluid connection between the tubing and the well bore;

(iii) a slidable internal sleeve disposed within the body with a plurality of ports adapted to align with the plurality of perforations and provide a fluid flow between the tubing and the well bore;

(iv) a locking profile disposed in the tubing proximate to the second end of the body; and (v) a seal bore disposed in the tubing between the plurality of ports and the locking profile providing a sealing engagement with the coiled tubing jet frac tool.

2. The system of claim 1, wherein the shifting tool comprises a collet disposed around the internal tubular core for engaging the slidable internal sleeve when the internal tubular core is moved by the coiled tubing.

3. The system of claim 1, wherein the locking key retainer fastener is a shear pin.

4. The system of claim 3, wherein the locking key retainer further comprises:

a. a locking key retainer sleeve; and b. a locking key retainer dog for engaging the seal bore of the sliding sleeve.

5. The system of claim 1, wherein the sliding sleeve connects two portions of the tubing to one another.

6. The system of claim 1, further comprising a jet disposed in one of the ports of the plurality of ports.

7. The system of claim 1, further comprising a jet disposed in one of the perforations of the plurality of perforations.

8. A method for multi-zone fracing of a formation adjacent a well bore comprising:

a. installing a tubing into the wellbore, wherein the tubing has a sliding sleeve disposed thereon, wherein the sliding sleeve comprises:

(i) a body comprising:

1. a first end; and
2. a second end;

(ii) a plurality of perforations disposed between the first end and the second end of the body, wherein the plurality of perforations provide a fluid connection between the tubing and the well bore;

(iii) a slidable internal sleeve disposed within the body with a plurality of ports adapted to align with the plurality of perforations and provide a fluid flow between the tubing and the well bore;

(iv) a locking profile disposed in the tubing proximate to the second end of the body; and (v) a seal bore disposed in the tubing between the plurality of ports and the locking profile;

b. attaching a coiled tubing multi-zone jet frac tool to a coiled tubing, wherein the coiled tubing multi-zone jet frac tool comprises:

(i) an internal tubular core with an internal tubular core first end with a shoulder, an internal tubular core second end;

(ii) a first port located between the shoulder and the internal tubular core second end, a second port located between the first port and the internal tubular core second end;

(iii) a slidable pack off mandrel comprising:

1. a first mandrel end with a first pack off element;
2. a second mandrel end with a drag collet for slidably engaging the internal tubular core and a locking key retainer;
3. at least one locking key for engaging with the locking key retainer disposed between the first mandrel end and the second mandrel end, wherein the at least one locking key is secured to the slidable pack off mandrel with a locking key retainer fastener; and
4. at least one shearable fastener disposed on the second mandrel end, wherein the slidable pack off mandrel slidably engages the internal tubular core; and (iv) a shifting tool disposed adjacent the internal tubular core second end;

c. running the coiled tubing multi-zone jet frac tool down the well bore using the coiled tubing to a preselected location below the sliding sleeve;

d. retrieving the coiled tubing multi-zone jet frac tool above the sliding sleeve to open the sliding sleeve and release at least one locking key from the locking key retainer;

e. running the coiled tubing multi-zone jet frac tool back into the sliding sleeve to engage the locking profile in the sliding sleeve;

f. setting the first pack off element using the shoulder to seal the inner tubular core from the tubing;

g. pumping fluid into the annulus and out of the plurality of ports into the formation to initiate fracturing of the formation; and h. retrieving the first pack off element while leaving the sliding sleeve in the wellbore.

* * * * *